US007922521B1

(12) United States Patent
Wu

(10) Patent No.: US 7,922,521 B1
(45) Date of Patent: Apr. 12, 2011

(54) DIN RAIL TERMINAL BLOCK

(76) Inventor: Shang Tsai Wu, Taipei Hsien (TW)

( * ) Notice: Subject to any disclaimer, the term of this patent is extended or adjusted under 35 U.S.C. 154(b) by 0 days.

(21) Appl. No.: 12/819,047

(22) Filed: Jun. 18, 2010

(51) Int. Cl.
*H01R 13/66* (2006.01)

(52) U.S. Cl. ..... 439/532

(58) Field of Classification Search ..... 439/532, 439/541.5, 700, 715–716, 92–95
See application file for complete search history.

(56) References Cited

U.S. PATENT DOCUMENTS 7,686,626 B2 * 3/2010 Wu et al. ..... 439/95
7,686,627 B2 * 3/2010 Wu et al. ..... 439/95
7,704,102 B2 * 4/2010 Nad ..... 439/716
7,862,389 B2 * 1/2011 Pizzi ..... 439/715
2003/0203671 A1 * 10/2003 Suess ..... 439/532

* cited by examiner

*Primary Examiner* — Jean F Duverne
(74) *Attorney, Agent, or Firm* — Muncy, Geissler, Olds & Lowe, PLLC

(57) ABSTRACT

A DIN rail terminal block essentially includes a plastic main body, a resilient plate, and a terminal. The resilient plate and the terminal are coupled together by multiple fastening structures and are simultaneously secured in position to the plastic main body, wherein the multiple fastening structures prevent the resilient plate and the terminal from shifting leftward, rightward, upward, or downward with respect to each other. With the terminal configured for ground connection, and the resilient plate configured for pressing tightly against a DIN rail, the terminal block is stably positioned, provides good electrical connection, and allows easy operation.

4 Claims, 5 Drawing Sheets

DIN RAIL TERMINAL BLOCK

BACKGROUND OF THE INVENTION

1. Technical Field

The present invention relates to a DIN rail terminal block. More particularly, the present invention relates to a terminal block configured to be movably mounted on a DIN rail and including a terminal and a resilient plate that are novel in design and are ingeniously interconnected to enable good electrical connection and secure fastening.

2. Description of Related Art

A DIN rail terminal block is a terminal block movably mounted on a DIN rail and using the DIN rail as an electrode. More specifically, the terminal block is fastened and electrically connected to the DIN rail by a terminal and a resilient plate in the terminal block. As several such terminal blocks of similar functions can be mounted on the same rail to save space and facilitate wiring, DIN rail terminal blocks are in extensive use.

A conventional DIN rail terminal block typically includes a plastic housing and a conductive terminal provided in the plastic housing and configured for contacting with a DIN rail. The plastic housing is secured in position to the rail by laterally provided screws which press against the rail. However, with such a positioning mechanism, not only are the screw threads of the plastic housing likely to be damaged, but also the surface of the rail tends to be scratched. In addition, as the screws need to be tightened or loosened during the positioning process, the entire fastening operation can be time consuming. Moreover, incomplete fastening may result in cases where there are too many wires but too little space. These are the major drawbacks of the aforesaid conventional DIN rail terminal block.

Another conventional DIN rail terminal block, known as the phoenix terminal block, includes a plastic housing, a conductive terminal in the plastic housing, and a curved metal fastener in a bottom portion of the plastic housing. The metal fastener has a curved surface for contacting with a DIN rail and thereby providing electrical connection as well as resilient fastening. Nevertheless, as the metal fastener contacts the rail with a curvedly bent portion, the area of contact for electrical connection is rather small, and hence the electrical connection tends to be incomplete. Besides, the curved surface of the metal fastener is subject to wear and tear, and assembly of the terminal block is laborious. Furthermore, since the terminal and the metal fastener are supported by engagement between plastic and metal elements in the housing, high-precision molds are required for making the terminal block, which disadvantageously adds to the complexity and costs of manufacture.

BRIEF SUMMARY OF THE INVENTION

The primary object of the present invention is to provide a DIN rail terminal block which essentially includes a plastic main body, a resilient metal plate, and a terminal. The resilient plate and the terminal are coupled together by multiple fastening structures and are simultaneously secured in position to the plastic main body, wherein the multiple fastening structures prevent the resilient plate and the terminal from shifting leftward, rightward, upward, or downward with respect to each other. With the terminal configured for ground connection, and the resilient plate for pressing tightly against a DIN rail, the terminal block is stably positioned, provides good electrical connection, and allows easy operation.

To achieve the foregoing object, the present invention provides a DIN rail terminal block including a plastic main body, a resilient plate, and a terminal.

The plastic main body has an end portion formed with at least one insertion hole, a bottom portion bilaterally provided with lateral hooks, and a lower portion centrally provided with a positioning post and at least one engaging hook. The resilient plate has one end protrudingly provided with a tenon and the other end provided with a curved fastening arm, wherein the fastening arm extends outward to form an L shape and has an inner side provided with a projection. In addition, the resilient plate is protrudingly provided with a pushing arm below the fastening arm. The resilient plate also has an axial hole and at least one positioning hole at appropriate positions thereof. The terminal includes a transverse plate whose two ends are respectively provided with claws. The transverse plate has a mortise corresponding in position to the tenon of the resilient plate. Besides, a central stop plate is erected from one side of a central section of the transverse plate, is protrudingly provided with a hollow post, and has an end provided with at least one connecting lug. Each connecting lug is connected with a rectangular box that extends into and is received in a corresponding one of the at least one insertion hole of the main body.

To assemble the DIN rail terminal block, the hollow post of the terminal is passed through the axial hole of the resilient plate and, together with the resilient plate, is mounted around the positioning post of the plastic main body, such that the metal terminal and the resilient plate are securely coupled together. At this time, the at least one engaging hook of the plastic main body is inserted and positioned in the at least one positioning hole of the resilient plate, thereby securing the resilient plate in position to the plastic main body. As the transverse plate of the terminal is now located below the resilient plate, and the tenon of the resilient plate is positioned in the mortise of the transverse plate, the terminal and the resilient plate are further fastened together. On the other hand, the fastening arm is received in a positioning groove at one end of the transverse plate to prevent the resilient plate from swinging leftward or rightward with respect to the terminal. The pushing arm is pressed resiliently against a top surface of the transverse plate of the terminal.

To mount the terminal block on a DIN rail with a flat U-shaped cross section, the two edges of the rail are inserted between the lateral hooks bilaterally provided in the bottom portion of the plastic main body such that the projection of the fastening arm at one end of the resilient plate is pressed tightly against the rail. Meanwhile, as the pushing arm of the resilient plate is pressed downward against the resilient plate of the terminal, surface contact is realized between the transverse plate and the rail to enable good electrical connection therebetween.

BRIEF DESCRIPTION OF THE SEVERAL VIEWS OF THE DRAWINGS

A detailed description of further features and advantages of the present invention is given below with reference to the accompanying drawings, in which.

DETAILED DESCRIPTION OF THE INVENTION

Figure 1:
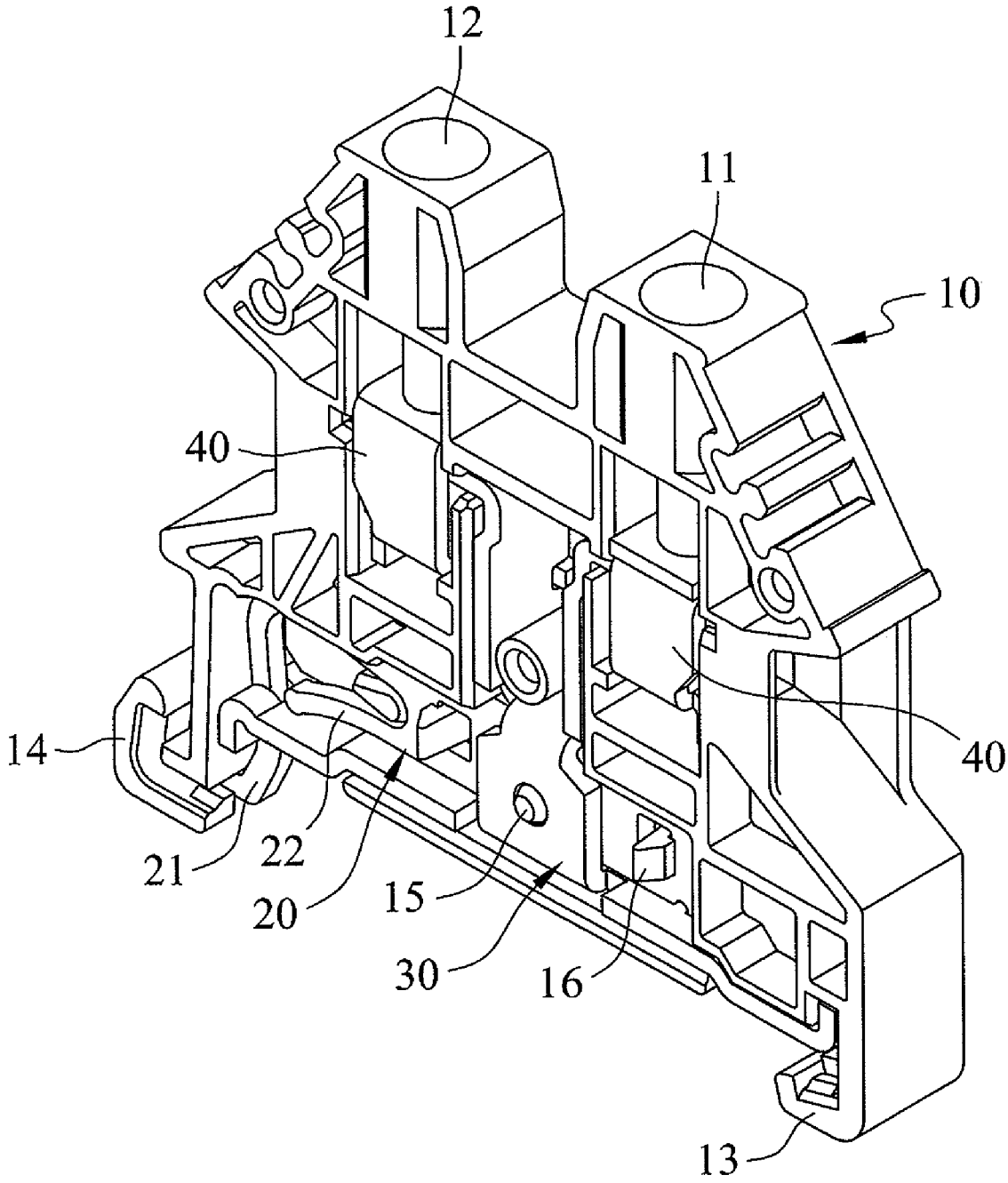
FIG. 1 is an assembled perspective view of the present invention.
Figure 2:
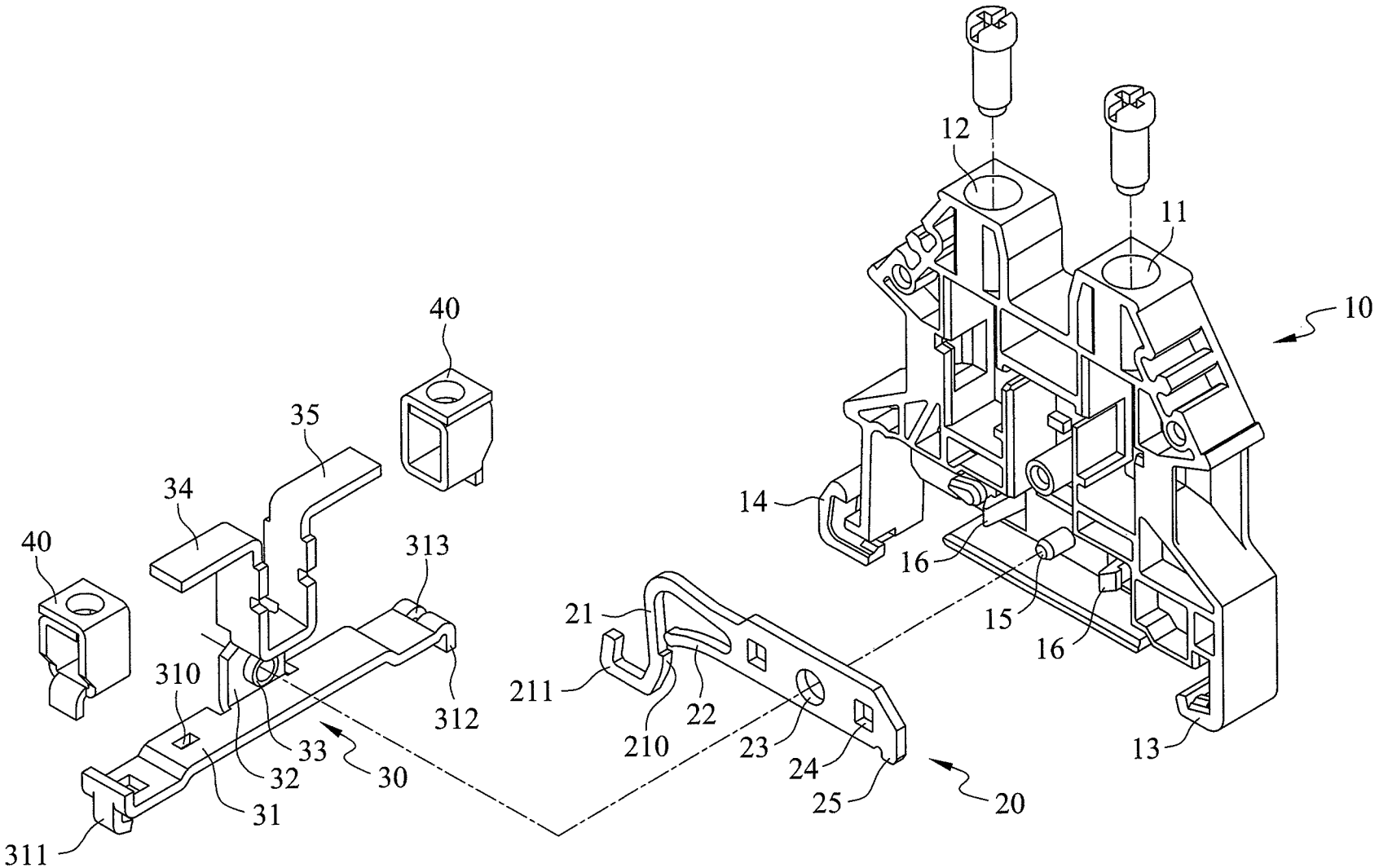
FIG. 2 is an exploded perspective view of the present invention.

Referring to FIGS. 1 and 2, a DIN rail terminal block according to an embodiment of the present invention includes a plastic main body 10, a resilient plate 20, and a terminal 30.

The plastic main body 10 has an end portion provided with two insertion holes 11, 12. The bottom portion of the main body 10 is bilaterally provided with lateral hooks 13, 14. A positioning post 15 and at least one engaging hook 16 are centrally provided in a lower portion of the main body 10. In the present embodiment, there are two engaging hooks 16, which are located on two sides of the positioning post 15, respectively.

The resilient plate 20 is transversely disposed in the bottom portion of the main body 10 and has one end protrudingly provided with a tenon 25 and the other end provided with a curved fastening arm 21. The fastening arm 21 extends outward to form an L shape and has an end formed with a reinforcing curved portion 211. Besides, a projection 210 is formed on an inner side of the fastening arm 21 to provide an inwardly pressing force. In addition, a pushing arm 22 is protrudingly provided below and parallel to the fastening arm 21 and is slightly curved outward. An axial hole 23 and at least one positioning hole 24 are formed at appropriate positions of the resilient plate 20 and correspond in position to the positioning post 15 and the engaging hooks 16 of the main body 10, respectively.

The terminal 30 includes a transverse plate 31. The two ends of the transverse plate 31 are respectively provided with claws 311, 312, wherein the claw 312 is centrally formed with a positioning groove 313. The transverse plate 31 also has a mortise 310 corresponding in position to the tenon 25 of the resilient plate 20. Moreover, a central stop plate 32 is erected from one side of a central section of the transverse plate 31. The central stop plate 32 is protrudingly provided with a hollow post 33 and has a bifurcated end provided with connecting lugs 34, 35. The connecting lugs 34, 35 are each connected with a rectangular box 40. The rectangular boxes 40 extend into and are received in the two insertion holes 11, 12 of the main body 10, respectively.

Figure 3:
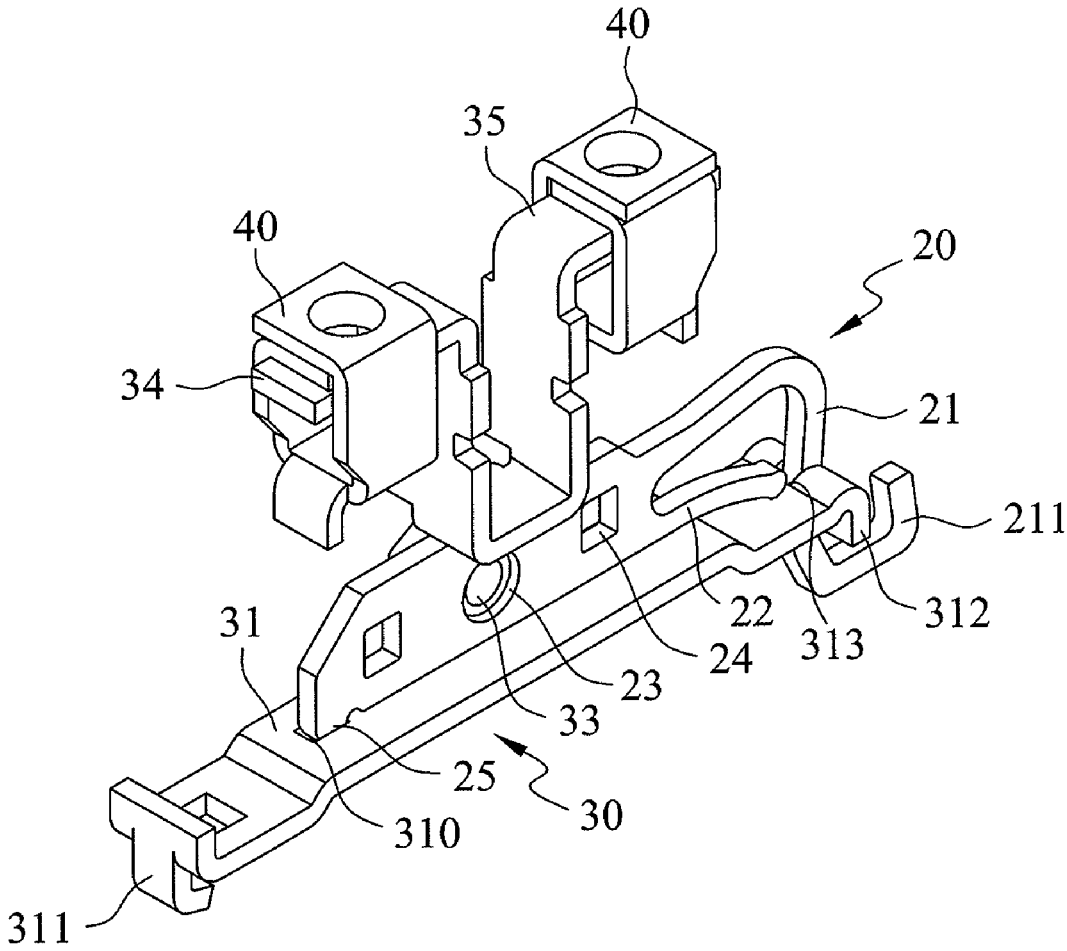
FIG. 3 is an assembled perspective view of a resilient plate and a terminal according to the present invention.
Figure 4:
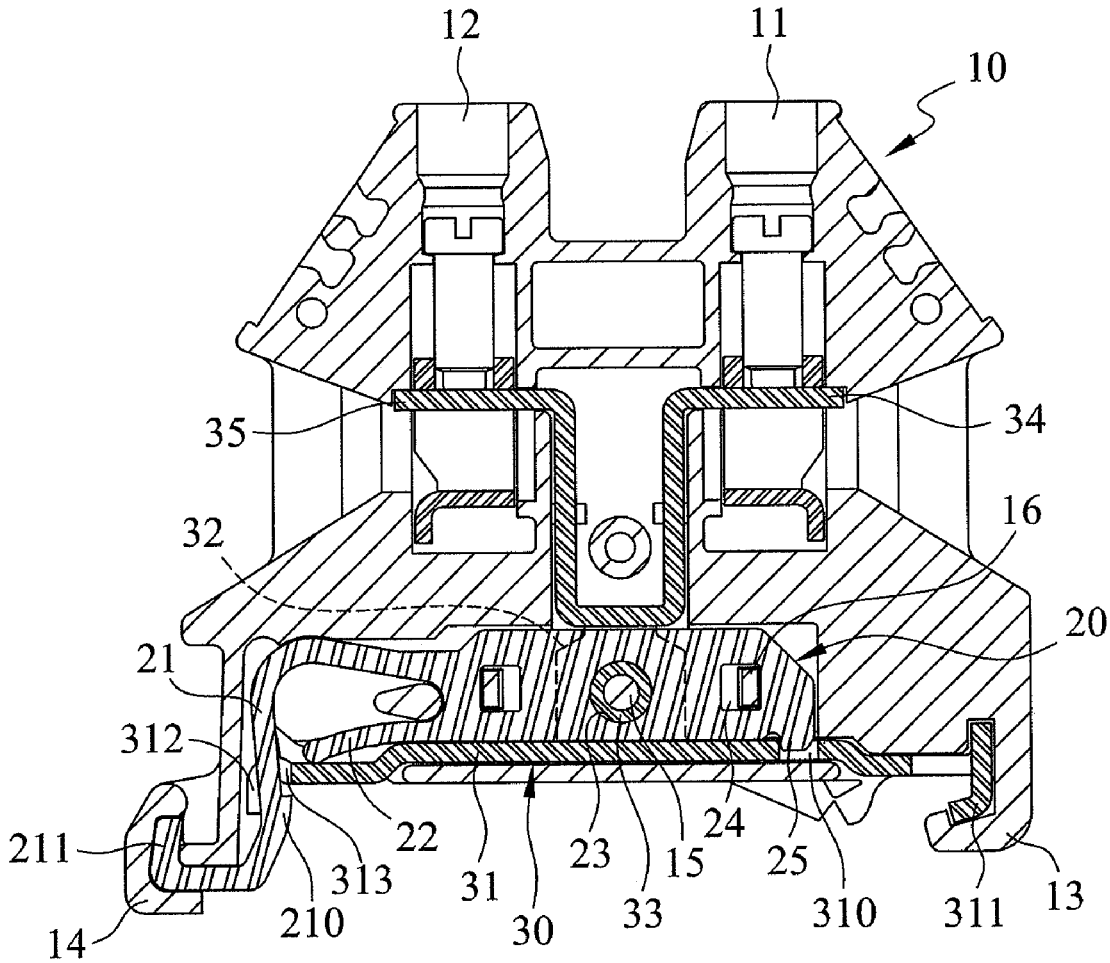
FIG. 4 is an assembled sectional view of the present invention.

Referring to FIGS. 2, 3, and 4, the DIN rail terminal block described above is assembled by passing the hollow post 33 of the terminal 30 through the axial hole 23 of the resilient plate 20 and mounting the hollow post 33, together with the resilient plate 20, around the positioning post 15 of the plastic main body 10. Thus, the metal terminal 30 and the resilient plate 20 are securely connected to each other, and the engaging hooks 16 of the plastic main body 10 are inserted and positioned in the positioning holes 24 of the resilient plate 20, respectively, such that the resilient plate 20 is secured in position to the plastic main body 10. Meanwhile, the transverse plate 31 of the terminal 30 is located below the resilient plate 20, as shown in FIGS. 3 and 4, and the tenon 25 of the resilient plate 20 is positioned in the mortise 310 of the transverse plate 31, thereby further fastening the terminal 30 and the resilient plate 20 together. Moreover, as the fastening arm 21 is received in the positioning groove 313 at one end of the transverse plate 31, the resilient plate 20 is prevented from swinging side to side with respect to the terminal 30. In addition, the pushing arm 22 is pressed resiliently against a top surface of the transverse plate 31 of the terminal 30.

Figure 5:
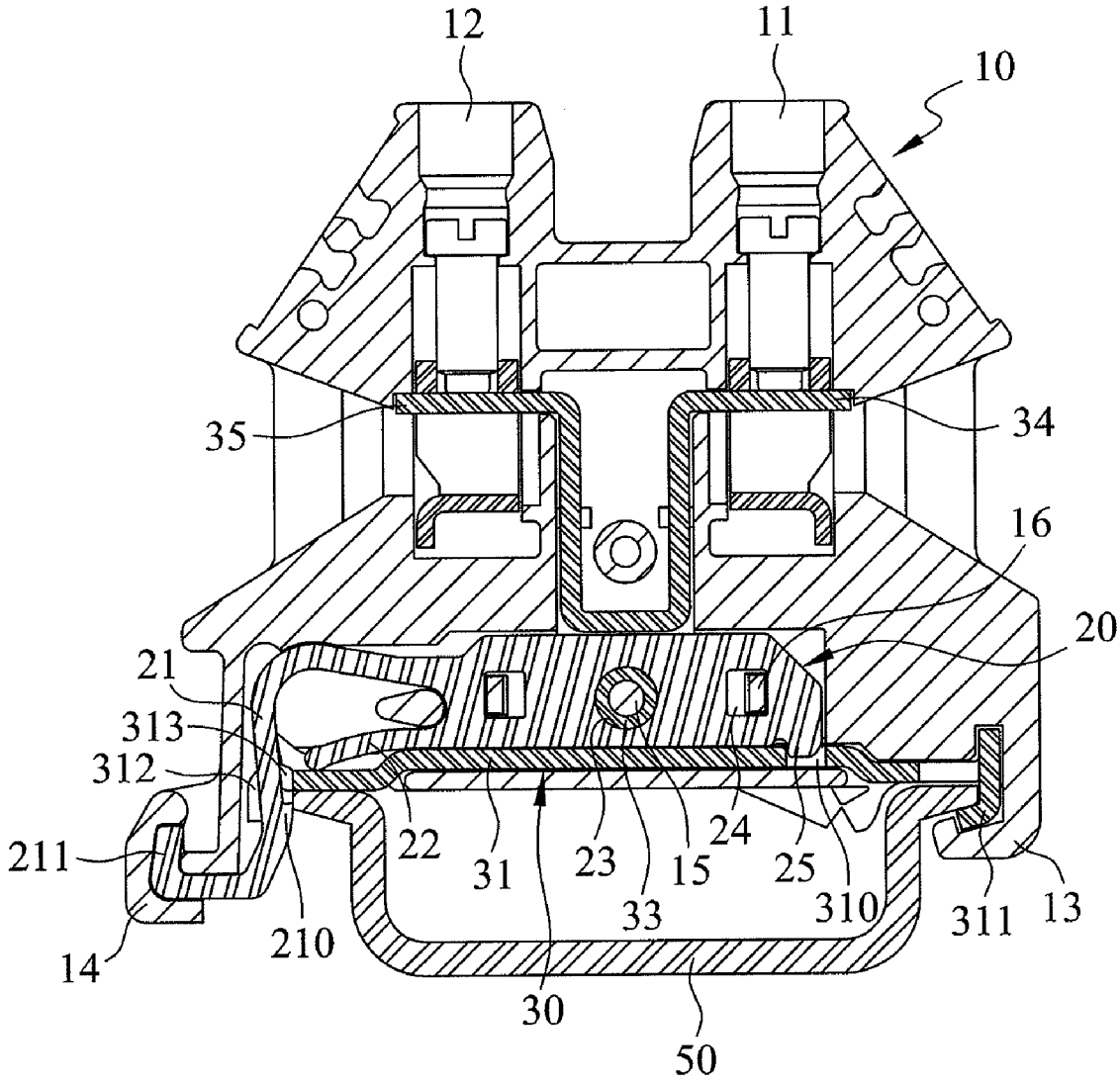
FIG. 5 is a sectional view of the present invention mounted on a DIN rail.

With reference to FIGS. 2 and 5, a DIN rail 50 is an elongate structure with a generally flat U-shaped cross section. The two edges of the rail 50, i.e., the two upper ends of the U-shaped structure, are inserted between the lateral hooks 13, 14 bilaterally provided in the bottom portion of the plastic main body 10. Thus, the projection 210 of the fastening arm 21 at one end of the resilient plate 20 is pressed tightly against the rail 50 while the pushing arm 22 of the resilient plate 20 is pressed downward against the transverse plate 31 of the terminal 30. As a result, a good electrical connection between the transverse plate 31 and the rail 50 is achieved by surface contact therebetween.

In short, according to the present invention, the plastic main body 10, the resilient plate 20, and the terminal 30 are coupled together by multiple fastening structures and hence prevented from shifting leftward, rightward, upward, or downward with respect to one another. In addition, with the resilient plate 20 configured for engaging with the rail 50, the terminal 30 configured for ground connection, and electrical connection between the transverse plate 31 and the rail 50 realized by surface contact, the DIN rail terminal block is stably positioned, provides good electrical connection, and allows easy operation.

The embodiment described above is only the preferred embodiment of the present invention and is not intended to limit the scope of the present invention. A person skilled in the art may change or modify the disclosed embodiment without departing from the spirit and scope of the present invention. Therefore, all equivalent or easily conceivable changes or modifications, such as the addition of other fittings, an increase or decrease in the number of the fastening structures, or minor changes in the shapes of the mechanisms used, should fall within the scope of the present invention, which is defined only by the appended claims.

According to the above description, and given the fact that the contents disclosed herein have never been made public prior to this application, the present invention meets the requirements of novelty, utility, and industrial applicability for patent application. Hence, an application for patent of the present invention is hereby filed for examination.

What is claimed is:

1. A DIN rail terminal block, comprising:

a plastic main body having an end portion provided with at least an insertion hole, a bottom portion bilaterally provided with lateral hooks, and a lower portion centrally provided with a positioning post and at least an engaging hook;

a resilient plate having an end protrudingly provided with a tenon and an opposite end provided with a curved fastening arm, the fastening arm extending outward to form an L shape, the fastening arm having an inner side provided with a projection, there being a pushing arm protrudingly provided below the fastening arm, the resilient plate further having an axial hole and at least a positioning hole at appropriate positions thereof; and a terminal comprising a transverse plate, the transverse plate having two ends each provided with a claw, the transverse plate having a mortise corresponding in position to the tenon of the resilient plate, there being a central stop plate erected from a side of a central section of the transverse plate, wherein the central stop plate is protrudingly provided with a hollow post and has an end provided with at least a connecting lug, each said connecting lug connected with a rectangular box extending into and received in a corresponding said insertion hole of the main body.

2. The DIN rail terminal block of claim 1, wherein there are two said engaging hooks provided on two sides of the positioning post, respectively.

3. The DN rail terminal block of claim 1, wherein one said claw of the transverse plate of the terminal is provided with a positioning groove.

4. The DIN rail terminal block of claim 1, wherein the resilient plate is transversely disposed in the bottom portion of the main body.

* * * * *